US007197965B1

(12) United States Patent
Anderson

(10) Patent No.: US 7,197,965 B1
(45) Date of Patent: Apr. 3, 2007

(54) HINGED SOCKET WRENCH SPEED HANDLE

(76) Inventor: Steven P. Anderson, 7625 Hayvenhurst Ave., Bldg. 39, Van Nuys, CA (US) 91406

( * ) Notice: Subject to any disclaimer, the term of this patent is extended or adjusted under 35 U.S.C. 154(b) by 0 days.

(21) Appl. No.: 11/416,823

(22) Filed: May 3, 2006

Related U.S. Application Data

(63) Continuation-in-part of application No. 10/507,827, filed on Sep. 14, 2004, now abandoned, which is a continuation-in-part of application No. PCT/US02/06093, filed on Feb. 25, 2002.

(51) Int. Cl.
*B25B 23/16* (2006.01)
*B25B 13/00* (2006.01)

(52) U.S. Cl. ..... 81/73; 81/177.9

(58) Field of Classification Search ..... 81/73, 81/35, 177.6, 177.7, 177.8, 177.9
See application file for complete search history.

(56) References Cited

U.S. PATENT DOCUMENTS

| | | | | |
|---|---|---|---|---|
| 460,256 | A | 9/1891 | Stewart | |
| 1,537,657 | A | 5/1925 | Burch | |
| 1,775,402 | A | 9/1930 | Mandl | |
| 1,779,203 | A | 10/1930 | Williamson | |
| 2,382,291 | A | 8/1945 | Carlberg | |
| 2,577,931 | A | 12/1951 | Tillman | |
| 2,712,765 | A | 7/1955 | Knight, Jr. | |
| 3,343,434 | A | 9/1967 | Schroeder | |
| 3,388,622 | A | 6/1968 | Klang | |
| 4,334,445 | A | 6/1982 | Timewell | |
| 4,541,310 | A | 9/1985 | Lindenberger | |
| 4,711,145 | A | 12/1987 | Inoue | |
| 4,901,608 | A * | 2/1990 | Shieh | 81/177.8 |
| 4,909,104 | A | 3/1990 | Mehlau et al. | |
| 4,929,113 | A * | 5/1990 | Sheu | 403/157 |
| 4,974,477 | A | 12/1990 | Anderson | |
| 5,279,189 | A | 1/1994 | Marino | |
| 5,280,740 | A | 1/1994 | Ernst | |
| 5,511,452 | A | 4/1996 | Edmons | |
| 5,768,960 | A | 6/1998 | Archuleta | |
| 5,802,936 | A * | 9/1998 | Liu | 81/450 |
| 5,904,077 | A | 5/1999 | Wright et al. | |
| 6,161,982 | A * | 12/2000 | Cole | 403/97 |
| 6,186,033 | B1 | 2/2001 | Faro, Sr. | |
| 6,324,947 | B2 | 12/2001 | Jarvis | |
| 6,349,620 | B1 | 2/2002 | Anderson | |
| 6,382,058 | B1 | 5/2002 | Owoc | |
| 6,401,576 | B1 * | 6/2002 | Wu | 81/177.4 |

* cited by examiner

*Primary Examiner*—David B. Thomas
(74) *Attorney, Agent, or Firm*—Albert O. Cota

(57) ABSTRACT

A hinged socket wrench speed handle having an offset shank (20) with a first end (22) and a second end (24). Attached to the first end (22) is a clevis (28) which receives a 180-degree drive head that is held by a hinge pin (40). The drive head consists of either a square drive head (30) or a ratchet drive head (31). To the second end (24) is attached a handle (58), which rotates the wrench. A second embodiment of the hinged socket wrench includes a second clevis (28) that is added to the second end (24) of the offset shank. The second clevis (28) adds further combinations of angular displacement of the handle (58). Thus increasing the value of the wrench as a tool and also its utility in difficult work areas. The wrench consists of five hinge pin (40) variations which provide additional surface interface with both the hinge pin and the handle yoke, thereby improving the structural integrity and prolonging the tool's life.

9 Claims, 7 Drawing Sheets

HINGED SOCKET WRENCH SPEED HANDLE

CROSS-REFERENCE TO RELATED APPLICATION

This application is a continuation-in-part of application Ser. No. 10/507,827 filed Sep. 14, 2004 now abandoned, which is a continuation-in-part of Application No. PCT/US02/06093 filed Feb. 25, 2002.

TECHNICAL FIELD

The invention pertains to the general field of socket wrenches, and more particularly to a speed handle for a socket wrench that has a single or double offset shaft to which is attached a lockable-position, square drive head or a ratchet drive head.

BACKGROUND ART

Previously, socket wrenches equipped with various types of speed handles, or spreader wrenches, have been used to provide a fast and easy method of rotating a threaded fastener using conventional sockets. The usual approach has been to utilize an extended handle having four 90-degree bends, and a rotating grip on one end and an offset parallel with the handle shaft. This configuration permits a user to grasp both the grip and offset portion simultaneously and to rotate the tool rapidly, much like a crank handle or a brace and bit. Many combinations of handle offsets and multiple bends have been utilized for sockets and screwdrivers in order to employ the principle of rapid manual rotation by the shape of the tool handle.

A search of the prior art did not disclose any patents that read directly on the claims of the instant invention, however the following U.S. patents are considered related:

| U.S. PAT. NO. | INVENTOR | ISSUED |
|---|---|---|
| 6,349,620 | Anderson | Feb. 26, 2002 |
| 5,768,960 | Archuleta | Jun. 23, 1998 |
| 5,511,452 | Edmons | Apr. 30, 1996 |
| 5,279,189 | Marino | Jan. 18, 1994 |
| 4,974,477 | Anderson | Dec. 4, 1990 |
| 3,388,622 | Klang | Jun. 18, 1968 |
| 2,712,765 | Knight, Jr. | Jul. 12, 1955 |
| 460,256 | Stewart | Sep. 29, 1891 |

My U.S. Pat. No. 6,349,620 issued Feb. 26, 2002 is the basis for the improvements of the instant invention. The improvements to my patent include two embodiments and five alternative variations of a slideable hinge pin that locks a drive head in place at a desired angle. These improvements are important because they provide additional surface interface with both the hinge pin and the handle yoke which improves the structural integrity of the invention as well as prolongs the life of the tool.

U.S. Pat. No. 5,768,960 issued to Archuleta is for a tilt wrench having a handle with a pair of opposed openings on each end that have different geometrical shapes. A tilt head has an additional shaped hole that is in alignment with the handle openings. A connector shaft having a round shape on one end and a square shape on the other end extends through the three openings and, when pressed inward interfaces with the tilt head, locking it in place. Selective axial positioning of the connector shaft allows the tilt head to be in either a locked or unlocked position.

Edmons in U.S. Pat. No. 5,511,452 teaches a speed handle with a ratchet drive having an offset located between the axis of the handle and the ratchet drive for use in tight places where there is little room for the handle. The balance of the speed handle is conventional, much like those currently available.

U.S. Pat. No. 5,279,189 issued to Marino has a pair of handles displaced longitudinally by a given distance, and a hinge connecting a coupling to an arm or one of the handles, thereby permitting relative movement therebetween about a pivot axis normal to the rotational axis of the coupling.

Anderson's patent 4,974,477 is for a speed wrench using an S-curve shaped shank. The shank causes the axis of the tool to intersect the axis of the handle, thereby creating a cone-shaped pattern of rotation, which permits the user to rotate the tool's handle with wrist motion.

Klank in U.S. Pat. No. 3,388,622 discloses a speed wrench consisting of a pair of concentric, rotatively-connected members. One arm is radially offset from the common axis of concentricity relative to the outer member such that cranking of the handle rotates a work engaging arm.

U.S. Pat. No. 2,712,765 issued to Knight, Jr. is for a wrist motion hand tool having a shaft with a pair of bends having a slight longitudinal or axial displacement in the bore of a pistol-grip shaped handle. The wrist motion of the user rotates the crank arm and only one hand is required to rotate a workpiece.

Stewart's U.S. Pat. No. 460,256 teaches a handle for a rotary tool using a pair of bends in a shaft that form a diagonal wrist. An anti-friction sleeve is added to the handle for ease of rotation.

For background purposes and as indicative of the art to which the invention relates reference may be made to the following patents found in the patent search.

| U.S. PAT. NO. | INVENTOR | ISSUED |
|---|---|---|
| 6,382,058 | OWOC | May 7, 2002 |
| 6,324,947 | Jarvis | Dec. 4, 2001 |
| 6,186,033 | Faro, Sr. | Feb. 13, 2001 |
| 5,904,077 | Wright, et al | May 18, 1999 |
| 5,280,740 | Ernst | Jan. 25, 1994 |
| 4,909,104 | Mehlau, et al | Mar. 20, 1990 |
| 4,711,145 | Inoue | Dec. 8, 1987 |
| 4,541,310 | Lindenberger | Sep. 17, 1985 |
| 4,334,445 | Timewell | Jun. 15, 1982 |
| 3,343,434 | Schroeder | Sep. 26, 1967 |
| 2,577,931 | Tillman | Dec. 11, 1951 |
| 2,382,291 | Carlberg | Aug. 14, 1945 |
| 1,779,203 | Williamson | Oct. 21, 1930 |
| 1,775,402 | Mandl | Sep. 9, 1930 |
| 1,537,657 | Burch | May 12, 1925 |

DISCLOSURE OF THE INVENTION

In today's economy, manpower is expensive and any tool or device that can reduce the time spent accomplishing a given task is of extreme importance. Therefore, the primary object of the invention is to provide a hand tool that can be utilized with most popular socket sets, and that shortens the time required to attach or remove a threaded fastener, with a polygon-shaped or other configured head, on a screw, bolt or nut. Normally, a ratchet handle is connected to a socket and ratcheted by radial motion with one hand while being held in place with the other hand. The instant invention permits a user to rapidly rotate a nut or bolt until it starts to tighten. The rapid rotation is accomplished by simple wrist action, with considerably more speed than a conventional ratchet handle. It has been determined that by using the instant invention the tightening or removal of a fastener, after its initial loosening, is four to five times faster.

Further, an important object of the invention is its ability to initially loosen or finally tighten a fastener by simply repositioning the handle at a suitable angle to gain the maximum amount of torque. The repositioning is provided in a 180-degree arc by a rotatable square drive head or a ratchet drive head that permits the socket to remain on a workpiece, and the handle to be moved to a convenient position like a standard breaker bar or flex handle. As the invention is relatively short and compact, a user may shift from a vertical position to a 45 or 90-degree angle in almost one continuous motion. This allows the user to maintain absolute control of the socket upon the workpiece and to continue adding torque until the workpiece is tightened, or the reverse if loosening is to be accomplished. As the result of the drive head being repositionable, any combination of angular displacement is easily accomplished without lost motion.

Another object of the invention is directed to a unique locking system that secures either the square drive head or the ratchet drive head at a given angle relative to the handle. This feature is particularly useful when the tool is used like a "bull handle" or an "L-handle". Further, the arrangement locks the head at equal angular increments, which are at the most convenient positions. It should also be noted that it is not necessary to lock the head, as it rotates under a small amount of tension and is temporarily held at the angular displacement by a spring-loaded detent so it can be controlled during operation. Locking is easily and intuitively obvious by simply pressing a hinge pin on one direction or the other for positive positioning at the 45-degree increment.

Still another object of the invention is the combination of a rotatable handle and an offset shank in a compact configuration. This coalescence of elements permits the user to use only one hand to rotate the socket easily, whereas conventional ratchets require two hands. Flex handles and the like require removing the socket each time the rotational limit is reached. Conventional speed handles are long and have limited utility as unrestricted space is essential to their function. In contrast, the instant invention is compact and may be used in most places that a conventional ratchet handle is normally employed, utilizing both the speed handle's quickness and the ratchet's usefulness.

Yet another object of the invention is realized in a second embodiment, wherein a second head is used that is similar in function, but only connects the shank to the handle, wherein the shank may be changed in its angular alignment relative to the handle. This embodiment is particularly useful in areas that are tight and hard to reach with conventional straight or fixed angle tools. It may be plainly seen that the use of another head permits the handle to be positioned independent of the square drive head or the ratchet drive head. Therefore, as many as five additional angles may be used in attempting to find the most practical approach to loosening or tightening a fastener, even under the most difficult circumstances.

Still another object of the second embodiment is a feature that permits the wrench to be positioned in crank fashion, with the handle vertical along with the square drive head. This unique position allows a fastener to be rotated like a crank handle, with the shank horizontal or angled 180, 90 or 45-degrees, while still retaining the ability to be rotated as described above in certain combinations of angles.

The improvement of the invention is embodied in the interface between the drive head and the hinge pin, as the round segment of the hinge pin is larger in diameter than across the flats of the square segment. The combined round and octagonal hole in the drive head has each inner angular apex shaved off by the introduction of a round portion of the hex hole. This arrangement allows the round segment of the hinge pin to interface with only the round portion of the hole instead of the sharp inside corners of the octagonal shape. It may be clearly seen that this arrangement takes the slop out of the interface, improves the life of the tool since without the combined round and octagonal hole the interface will quickly wear out, and greatly strengthens the integrity of the invention.

A final object of the improvement of the invention is directed to the inclusion of five separate, but related, variations of the slideable hinge pin that locks the drive head in place at a desired angle. Any one of the five variations provides additional surface interface with both the hinge pin and the handle yoke, which prolongs the life of the tool.

These and other objects and advantages of the present invention will become apparent form the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment and a second embodiment of a hinged socket wrench speed handle. Both embodiments are alike except the second embodiment has an additional pivoting head on the end of an offset shank that is located adjacent to the handle. The preferred embodiment is shown in FIGS. 1 through 23, with a single pivoting head shown in FIGS. 1, 2, 3, 11, 21 and 22. The second embodiment with the additional pivoting head is shown in FIGS. 12, 13, 17, 18, 19, 20 and 23.

Figure 1:
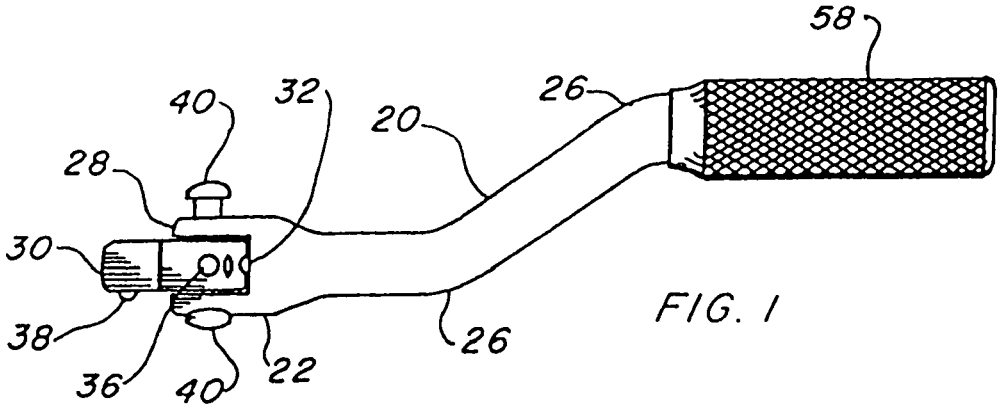
FIG. 1 is a plan view of the preferred embodiment having attached a square drive head.
Figure 2:
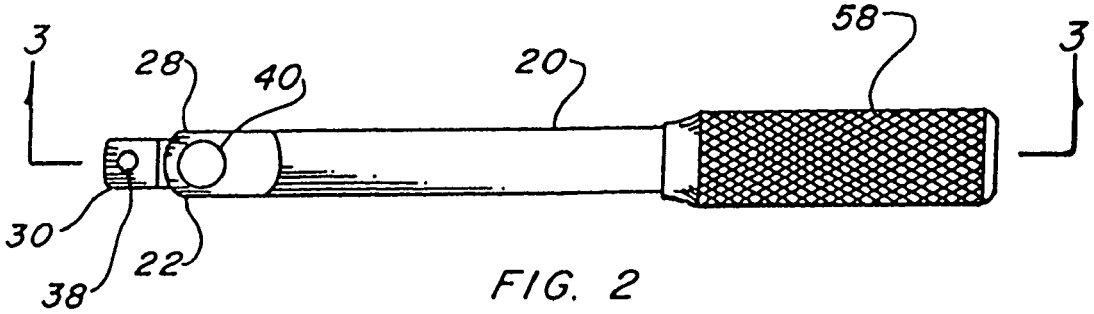
FIG. 2 is a side view of the preferred embodiment having attached the square drive head.
Figure 3:
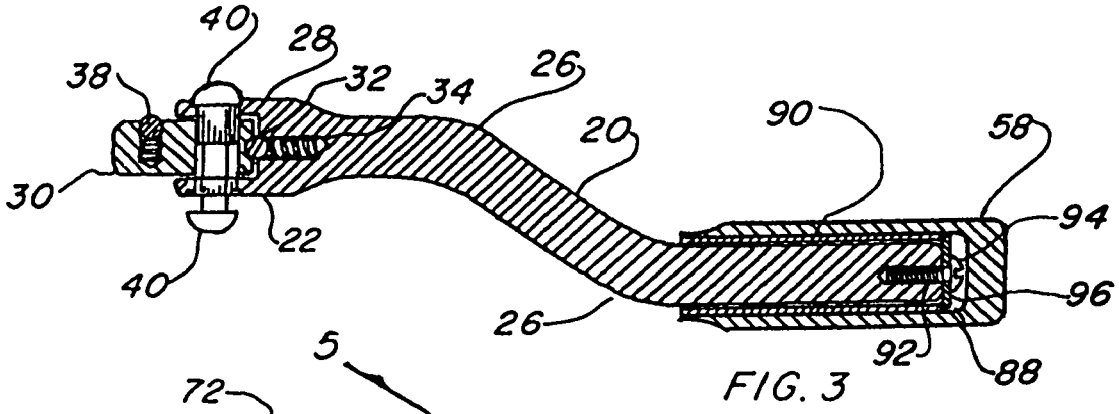
FIG. 3 is a cross-sectional view taken along lines 3—3 of FIG. 2 illustrating the internal structure of the invention.
Figure 11:
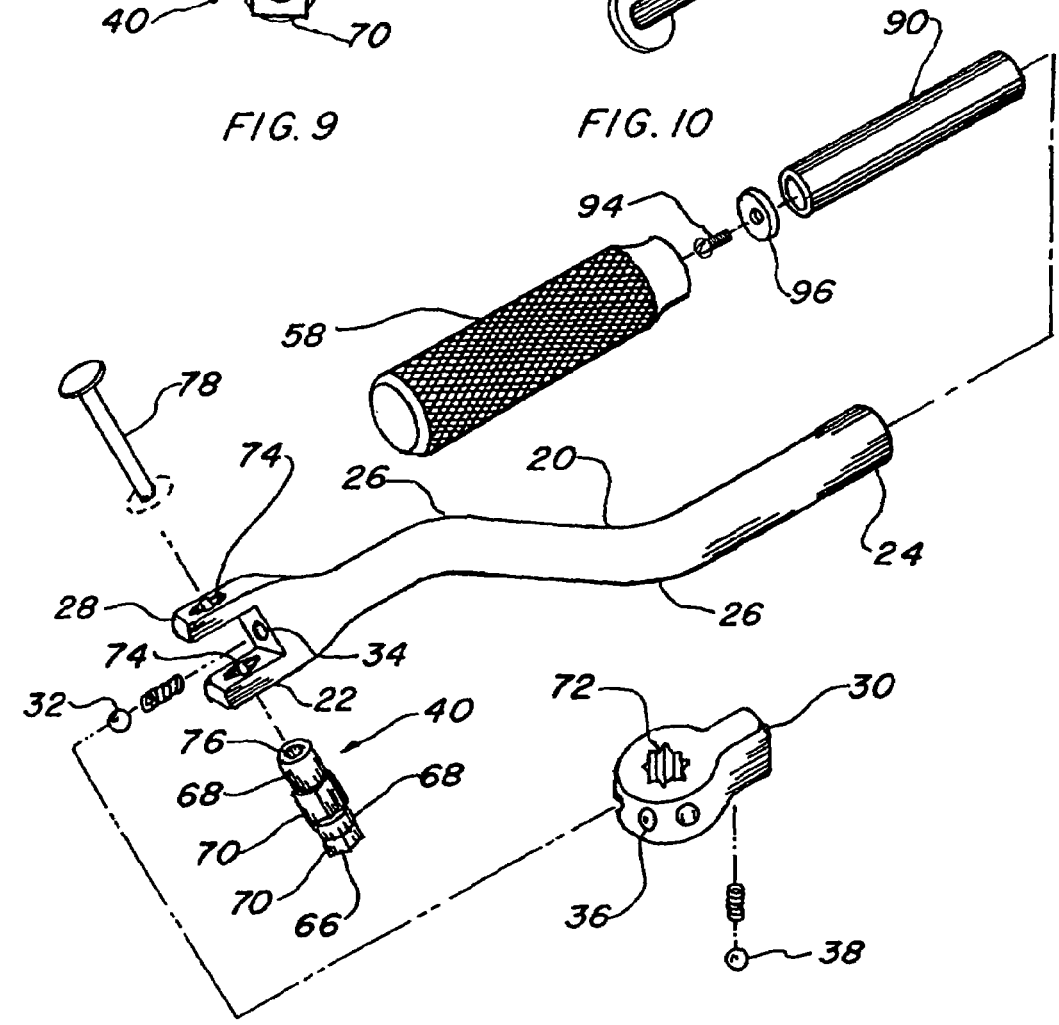
FIG. 11 is an exploded view of the preferred embodiment with a square drive head.
Figure 12:
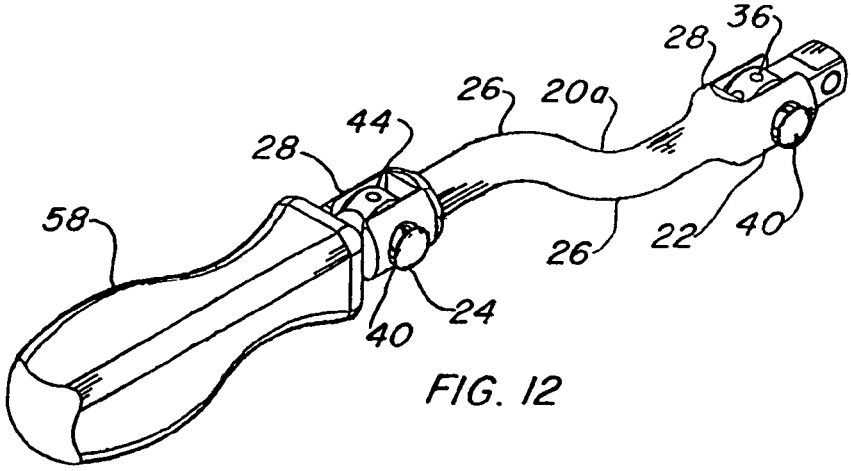
FIG. 12 is a partial isometric view of the second embodiment having attached a square drive head.
Figure 13:
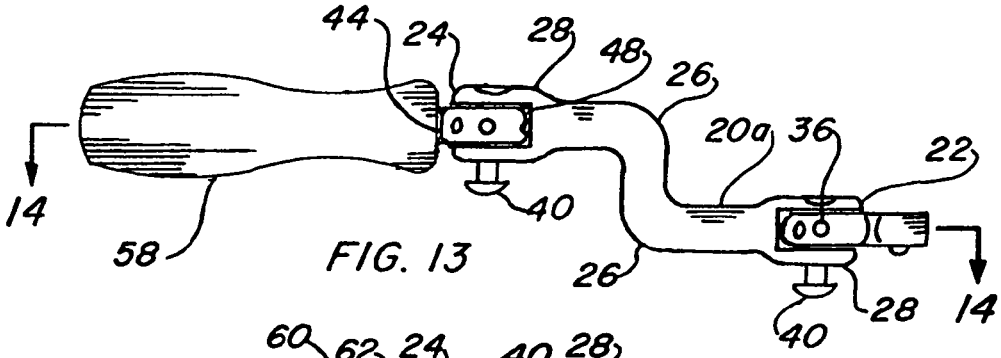
FIG. 13 is a plan view of the second embodiment having attached a square drive head.

The offset shank 20, in either embodiment, is round in shape and is made of metal, has a first end 22, a second end 24, and two opposed bends 26 that are integrally formed or forged during fabrication. The bends 26 are of equal angles from 10-degrees to 90-degrees, with 45-degrees being preferred, and the first end 22 and second end 24 are parallel in each opposed direction, as illustrated in FIGS. 1, 3 and 11. A clevis 28 is integrally formed into the first end 22 of the shank, thus forming a bifurcated fork, as illustrated best in FIG. 11.

Figure 21:
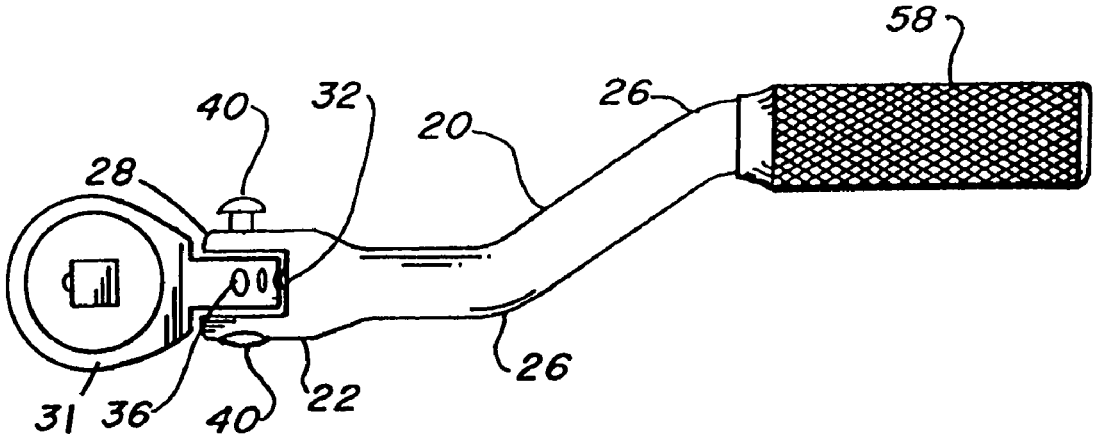
FIG. 21 is a plan view of the preferred embodiment which has attached a ratchet drive head with the socket end of the ratchet in view.
Figure 22:
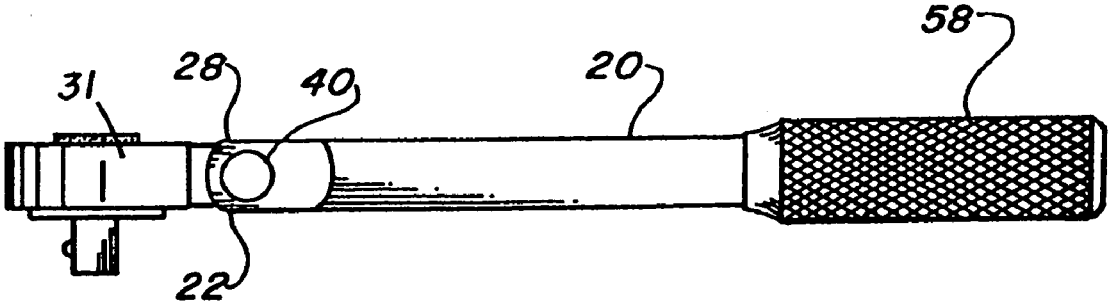
FIG. 22 is a side view of the preferred embodiment having attached a ratchet drive head.
Figure 23:
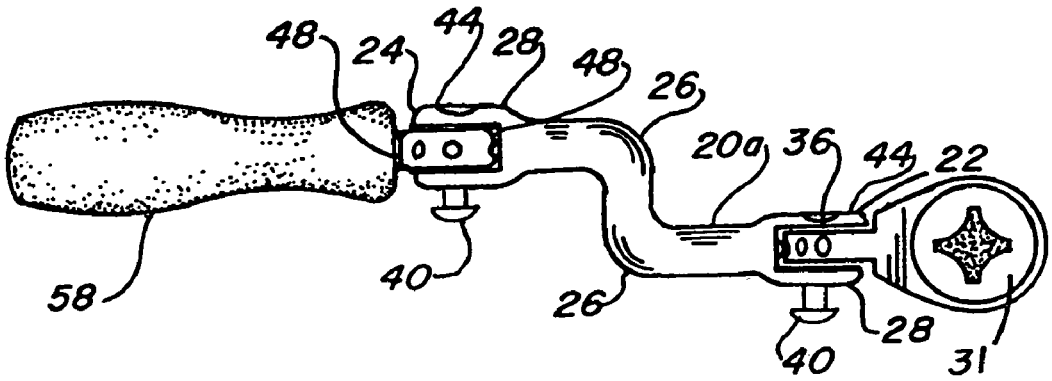
FIG. 23 is a plan view of the second embodiment having attached a ratchet drive head with the ratchet drive reversing lever in view.
Figure 24:
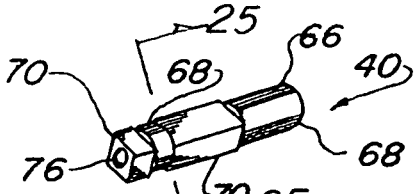
FIG. 24 is a partial isometric view of the preferred embodiment of the hinge pin with a through-bore for rivet attachment.
Figure 25:
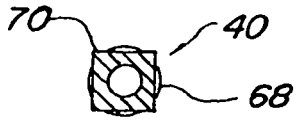
FIG. 25 is a cross-sectional view taken along lines 25—25 of FIG. 24.
Figure 26:
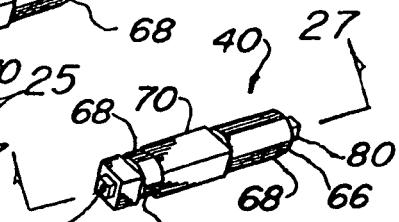
FIG. 26 is a partial isometric view of the preferred embodiment of the hinge pin with tapped holes for screw attachment.
Figure 27:
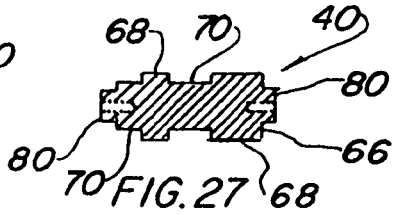
FIG. 27 is a cross-sectional view taken along lines 27—27 of FIG. 26.
Figure 28:
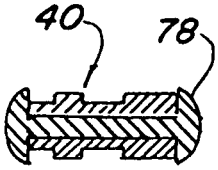
FIG. 28 is a cross-sectional view taken along the centerline of the hinge pin with a rivet in place and bucked into a mating head.

In both embodiments, either a square drive head 30 or a ratchet drive head 31 may be pivotally disposed within the shank first end 22. Both heads 30, 31 can be configured to accept wrench sockets. Preferably, the drive heads 30 and 31 are dimensioned to fit a conventional ¼-inch, ⅜-inch and ½-inch drive, however other sizes may be included and used with equal ease (such as metric sizes). The square drive head is shown in FIGS. 1–6, 11–14 and 18–20, while the ratchet drive head is shown in FIGS. 21, 22 and 23. For brevity, the remainder of this disclosure will only make reference to the square drive head 30, which also applies to the ratchet drive head 31.

Figure 4:
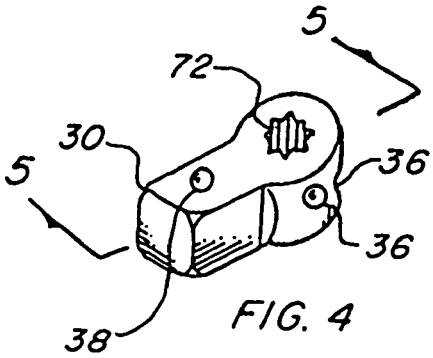
FIG. 4 is a partial isometric view of the square drive head completely removed from the invention for clarity.
Figure 5:
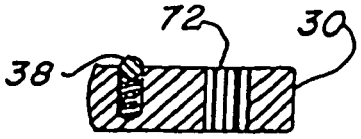
FIG. 5 is a cross-sectional view taken long lines 5—5 of FIG. 4.
Figure 6:
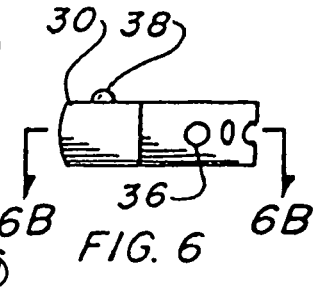
FIG. 6 is a side view of the square drive head completely removed from the invention for clarity.

The assembly of the drive head 30 into the clevis 28 allows an angular position retaining means, which comprises means to intersect rotation with at least five discrete positions, with a total displacement of 180-degrees, as defined by the utilization of a spring-loaded detent ball 32. The ball 32 is located within a bore 34 in the bifurcated fork, and the drive head 30 contains a plurality of coequally-spaced depressions 36, with 45-degrees being preferred, as illustrated in FIGS. 4, 6 and 11, however any number of equal spaces may be employed with like ease and utility. The detent ball 32 intersects with the depressions 36, which holds the drive head 30 in specific angular positions. The invention can also easily be adjusted by hand when another angle is desired. It should be noted that the drive head 30 contains a spring-loaded drive detent 38 for holding sockets in place, which is well known in the art and in common usage.

Figure 14:
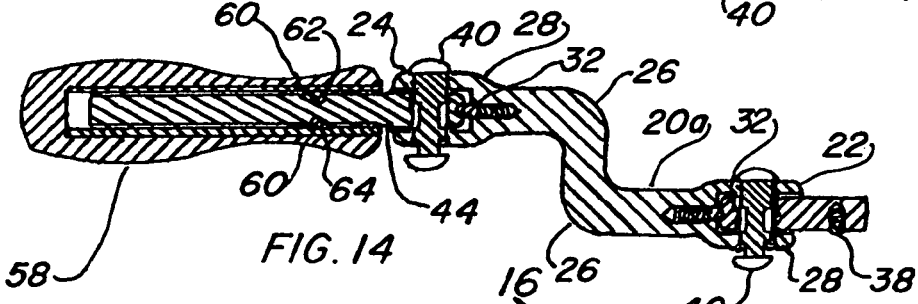
FIG. 14 is a cross-sectional view taken along lines 14—14 of FIG. 13.
Figure 15:
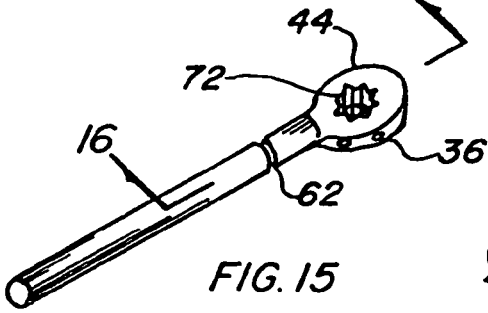
FIG. 15 is a partial isometric view of the second embodiment offset shank.
Figure 16:
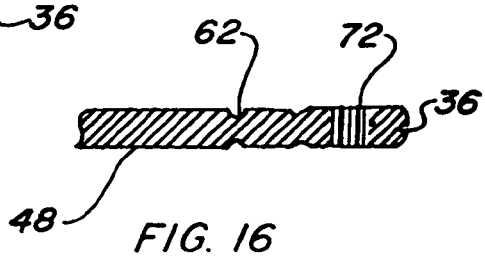
FIG. 16 is a cross-sectional view taken along lines 16—16 of FIG. 15.
Figure 17:
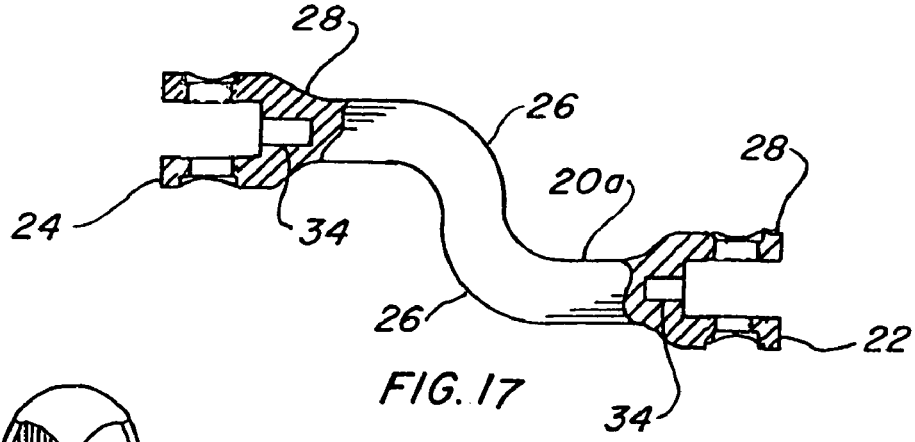
FIG. 17 is a plan view of the second embodiment offset shank with the ends partially cut away for clarity.

The square drive head 30 is rotatably held between the jaws of the forked clevis 28 with a slideable hinge pin 40, as shown in FIGS. 7, 8, 11, 24–30 and 33–36, thereby permitting the drive head to pivotally rotate and lock within the confines of the clevis 28. Securement means to hold the hinge pin 40 in position from sliding from one side to the other is provided, as shown in FIGS. 3, 11, and 14, by the constant lateral urging of the spring-loaded detent ball 32.

The hinge pin 40 is disposed through at least one square drive head 30 or ratchet drive head 31, and the clevis 28 bifurcated fork, thereby permitting the drive head 30 to pivotally rotate and lock within the confines of the clevis 28. The hinge pin 40 is slideable and held in position by lateral urging of the spring-loaded detent ball 32, as previously discussed. There are five variations of the slideable hinge pin 40, as shown in cross-sectional views of FIGS. 33–42, with the preferred variation illustrated in FIGS. 1–3, 7–14, 18–24, 25, 28 and 33.

In the first four variations the invention utilizes the hinge pin 40 that has a metallic body 66 with at least one round segment 68 and at least one square segment 70, and also means for retaining the hinge pin 40 within the hinged socket wrench speed handle. Both the square and ratchet drive head 30 and 31 contain a combined round and octagonal hole 72 therethrough, as illustrated in FIGS. 4, 11, 14 and 31. The reason that the hole 72 is described as being combined round and octagonal is that a round hole is bored first and two square holes are broached within the round hole. This design leaves internal intervening points radially truncated such that the round segment 68 of the hinge pin body 66 may slide easily inside without interference, while leaving the outside points sharp to interface with the square segment 70.

Figure 32:
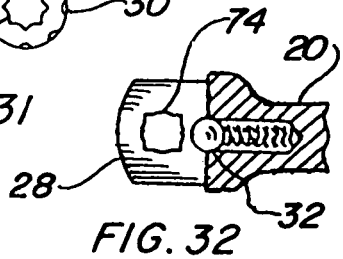
FIG. 32 is an arbitrary cross-sectional view of the clevis integrally formed into the first end of the shank forming the bifurcated fork showing the combined round and square hole that interfaces with the hinge pin.

The clevis 28 has a combined round and square hole 74 through each clevis fork, as illustrated in FIGS. 11 and 32, such that when the hinge pin 40 is manually urged in a first direction, the pin 40 is retained in the drive head 30 or 31 and rotates freely within the clevis 28. When the hinge pin 40 is urged in an opposite second direction, the square segment 70 intersects with the shank clevis 28, thereby locking the drive head 30 or 31 in place.

Figure 6A:
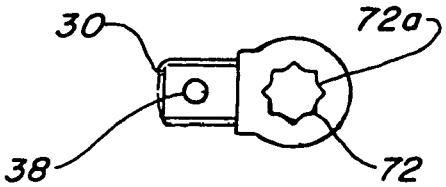
FIG. 6A is a top elevational view of the square drive head completely removed from the invention for clarity.
Figure 6B:
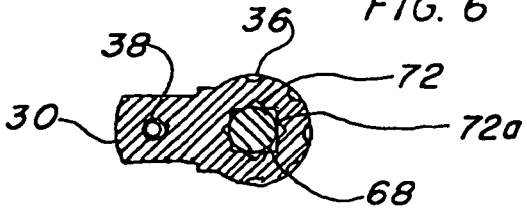
FIG. 6B is a cross-sectional view taken along lines 6B and 6B of FIG. 6.
Figure 7:
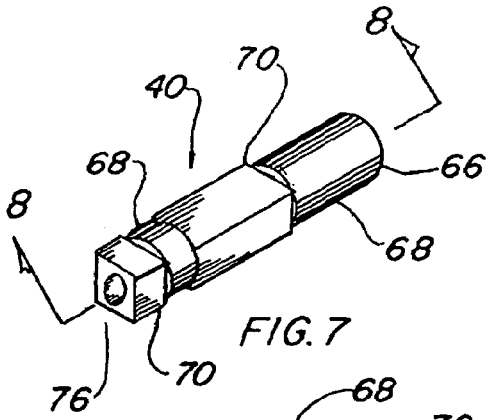
FIG. 7 is a partial isometric view of the hinge pin completely removed from the invention for clarity.
Figure 8:
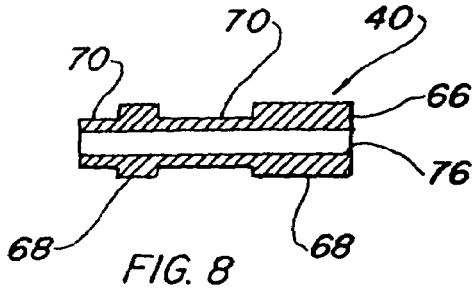
FIG. 8 is a cross-sectional view taken along lines 8—8 of FIG. 7.
Figure 9:
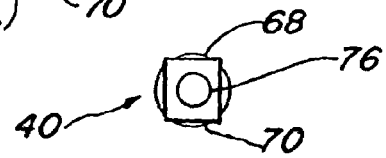
FIG. 9 is a partial isometric view of one of the lock rings.
Figure 10:
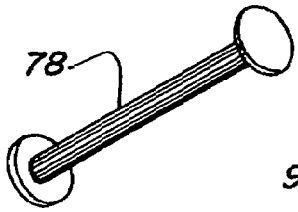
FIG. 10 is a cross-sectional view taken along lines 10—10 of FIG. 9.

The combined round and octagonal hole 72 in the heads 30 and 31 each have their inner angular apex shaved off by the introduction of a round portion 72*a* within the hex hole, as illustrated in FIG. 6A. This arrangement allows the round segment of the hinge pin to interface with only the round portion 72*a* of the hole instead of the sharp inner corners of the octagonal shape if the hole were not present. This embodiment is illustrated in FIG. 6B.

The means for retaining the hinge pin 40 within the hinged socket wrench speed handle are presented in three acceptable deviations, as they each accomplish the same task only in a different manner. The preferred retaining means utilizes a bore 76 in the hinge pin body 66 running completely through from end to end, as shown pictorially in FIGS. 8 and 28. A rivet 78 is disposed within the bore 76, with the rivet head larger in diameter than the combined round and square hole 74 through each fork of the clevis 28. The rivet 78 forms a limiting restriction that retains the hinge pin 40 in the fork clevis 28. The unheaded end of the rivet 78 is bucked, thus forming a similar head. FIG. 11 shows the unheaded end dotted, and FIGS. 10, 28 and 33–36 illustrate the head bucked.

Figure 29:
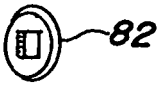
FIG. 29 is a partial isometric view of one of the hinge pin stops completely removed from the invention for clarity.
Figure 30:
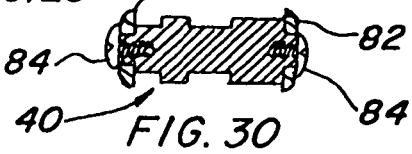
FIG. 30 is an arbitrary cross-sectional view taken along the centerline of the hinge pin with screws attached to hold the hinge pin stops in place.
Figure 31:
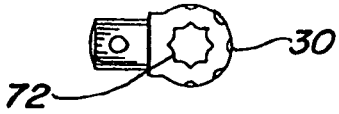
FIG. 31 is a top plan view of the drive head with the depressions illustrated as if it were a cross-section view. The view is provided to clearly show the combined round and octagonal hole that interfaces with the hinge pin.

The second means for retaining the hinge pin 40 within the hinged socket wrench speed handle is illustrated in FIGS. 26, 27, 29 and 30, wherein the hinge pin 40 includes a threaded extended neck 80 on each end. A hinge pin stop 82, shown by itself in FIG. 29, is disposed on each end of the neck 80 and is attached with a screw 84 fastened within the threads of the neck 80. The hinge pin stops 82 also have a larger diameter than the combined round and square hole 74 through each fork of the clevis 82, thus forming a limiting restriction that retains the hinge pin 40 in the clevis fork. In both variations of the hinge pin retaining means the head of the rivet 78 and the hinge pin stop 82 are round and may be contoured to follow the shape of the outer surface of the clevis 28. The third variation is illustrated in FIGS. 37–42 with a retaining ring 52 holding the hinge pin 40 in place.

Figure 33:
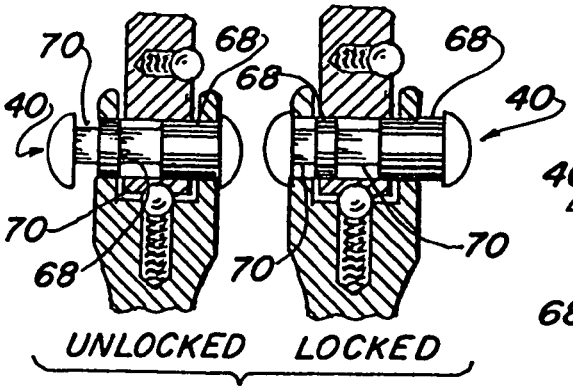
FIG. 33 is an arbitrary cross-sectional view of the wrench body yoke, with the hinge pin in place in a fully engaged embodiment with the pin rotating in conjunction with the drive head, shown in both the unlocked and locked position.

As stated previously there are five variations of the hinge pin 40, with four shown in the cross-sectional views of FIGS. 33–36. All of the variations are acceptable as far as function is concerned, with the difference being in the rotation of the pin and the amount of engagement between the elements. The preferred variation, as illustrated in FIG. 33 and also shown in the balance of the drawings, consists of a fully engaged hinge pin 40 with alternating two round segments 68 and two square segments 70. It should be noted that the square segments 70 have ends or points that extend beyond the diameter of the round segments 68 which lock into the holes 72 and 74 of the clevis 28 and drive heads 30 and 31, whereas the round segments 68 rotate freely. The unlocked illustration of FIG. 33 shows the pin 40 extending to the left of the clevis 28, with a square segment 70 completely on the outside and the adjoining round segment 68 engaging the combined round and square hole 74 of the clevis 28.

The adjacent second square segment 70 securely interfaces with the combined round and octagonal hole 72 in the drive head 30 or 31, with the last round segment 68 rotating within the clevis 28. It will be clearly seen that the drive head 30 or 31 is secured into the square segment 70, embracing the pin 40 which, in combination, is free to rotate as the round segments 68 are configured to revolve and slide easily within the drive head and clevis holes 72 and 74. To lock the pin 40 in place, the pin is simply slid to the right by manually pushing on the head, where the opposite action takes place with both the pin and drive head in contact with a square segment 70, thereby locking the two elements tightly together. As explained previously, the hinge pin 40 is held in place by the constant lateral urging of the spring-loaded detent ball 32 in the depressions 36 on either of the drive heads 30 or 31.

Figure 34:
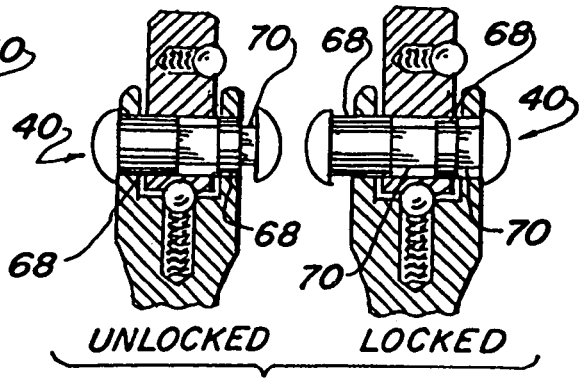
FIG. 34 is an arbitrary cross-sectional view of the wrench body yoke, with the hinge pin in place in a fully engaged embodiment with the pin rotating in conjunction with the drive head, shown in both the unlocked and locked position, except that it is in an opposite hand configuration of FIG. 33.

FIG. 34 illustrates basically the same configuration as the preferred variation, except it is left handed or opposite in its function, which in the unlocked position the head is flush with the left side of the clevis 28 and protrudes on the right. The functioning of this variation is the same fully engaged type, with the pin 40 rotating within the clevis and drive head.

Figure 35:
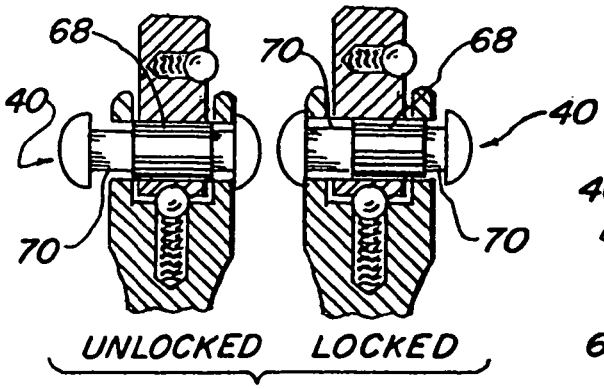
FIG. 35 is an arbitrary cross-sectional view of the wrench body yoke, with the hinge pin in place in a partially engaged embodiment with the pin stationary relative to the drive head, shown in both the unlocked and locked position.

FIG. 35 depicts a partially engaged variation with the pin 40 stationary. There is only one round segment 68 and two square segments 70 that function in the unlocked condition by having the square segments in contact with the clevis 28. This variation eliminates rotation, while the round segment 68 permits the drive head 30 or 31 to move freely. When the pin 40 is slid to the right the two square segments interface with the clevis 28 fully on the left side, and partially on the drive head and right side of the clevis, thus locking both together.

Figure 36:
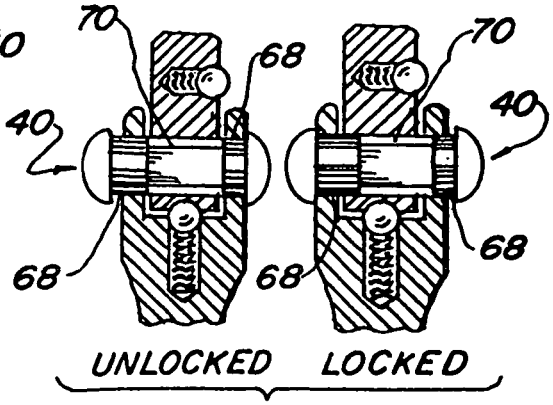
FIG. 36 is an arbitrary cross-sectional view of the wrench body yoke, with the hinge pin in place in a partially engaged embodiment with the pin rotating in conjunction with the drive head, shown in both the unlocked and locked position.

The variation shown in FIG. 36 is like the previous configuration except it utilizes two round segments 68 and one square segment 70. When unlocked, the square segment 70 interfaces with the drive head 30 or 31, rotating the pin 40. When manually pushed to the left, the square segment 70 partially engages both drive head and right side of the clevis, locking them together.

It should be noted that five positions of the retaining means are shown employing the spring-loaded detent ball 32, however the invention is not restricted to this specific number as any number of intervening polygonal depressions 36 may be easily utilized in incremental spacing. The drive head securement means is shown in the drawings and described as utilizing a square or polygonal shank 46 and an octagonal or polygonal depression 56, a combination of one or more round segments 68 and one or more square segments 70, to employ any polygonal shape in both elements. Thus as long as the depressions have a double amount of facets as that of the shank increasing the number of positions available for the angular displacement of the drive head 30 within the clevis 28, still falling within the bounds of this invention.

Figure 37:
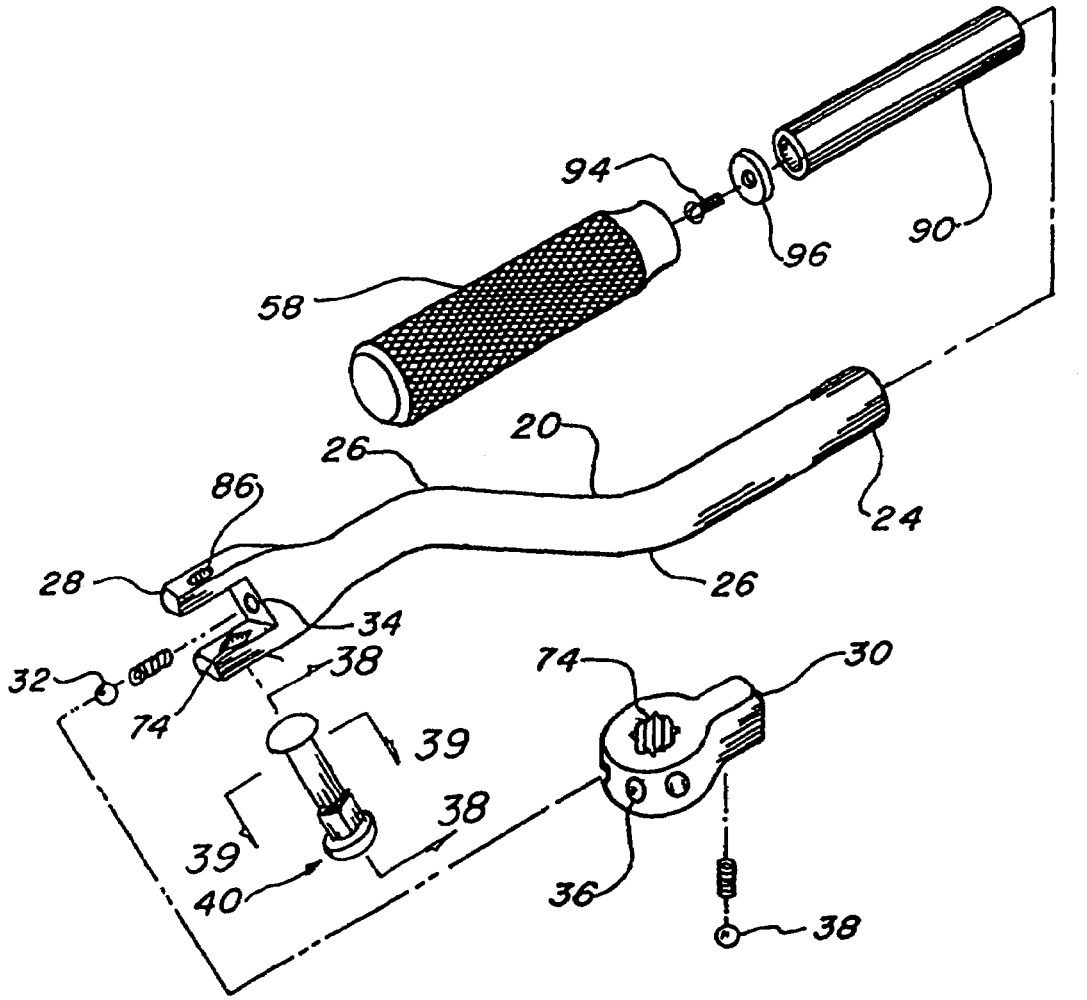
FIG. 37 is an exploded view of the fifth variation of the slideable hinge pin.
Figure 38:
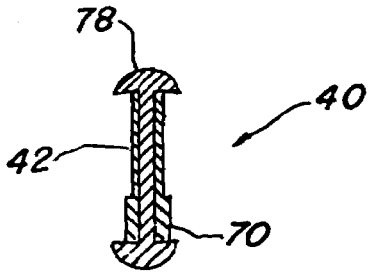
FIG. 38 is a cross-sectional view taken along lines 38—38 of FIG. 37.
Figure 39:
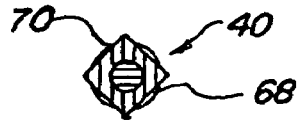
FIG. 39 is a cross-sectional view taken along lines 39—39 of FIG. 37.

The fifth variation is illustrated in FIGS. 37–39 and differs only slightly than the other four in the hinge pin 40 configuration. The hinge pin 40 of the fifth variation is shown removed from the invention for clarity in FIGS. 38 and 39, and consists of a round body 42 with a rivet 78. The hinge pin 40 penetrates the clevis 28 through a combined round and square hole 74 in one fork of the clevis 28, and a round hole 86 in the other fork. This arrangement permits locking the clevis 28, as the round segment of the hinge pin 40 is larger in diameter than the flats on the square segment.

In all variations a rotatable handle 58 is attached to the second end 24 of the shank 20, thereby permitting rotation of the wrench upon reciprocation of the handle, and radial turning when urged at right angles to the head 30. There are a number of methods that permit the handle 58 to reciprocate, with the preferred method illustrated in FIG. 3. The handle 58 is normally fabricated of a type of thermoplastic and includes a bore 88 therein that does not penetrate completely through. A handle sleeve 90 that has a slightly larger inner diameter than the offset shank 20 is placed over the shank 20. The shank includes a threaded hole 92 in the end, in which a screw 94 retains a washer 96 that abuts tightly against the end of the shank 20.

The entire handle assembly is pressed into place since the sleeve 90 is slightly larger than the bore 88 and the washer 96 has a smaller outer diameter than that of the sleeve 90. The handle assembly is forced into the bore 88 until the head of the screw 94 almost touches the end of the bore 88, thereby precluding the screw from ever backing out. It may be clearly seen that the handle 58 is free to rotate and the clearance between the sleeve 88 and shank 20 is such that, with a small amount of lubricant added to the interface, the rotation is easy and permanent.

An alternate method may also be employed which is simple and easy, however it does not have the robust and durable features as the preferred embodiment. The handle 58 in the second method is rotatably held in place by a round retaining ring 60, which interfaces with an internal groove 62 in the handle and an external groove 64 in the shank 20. These items are well known in the art for attachment of handles to tools. The handle 58 may be cylindrical, as shown in FIGS. 1–3 and 11, or contoured, as illustrated in FIGS. 12–14 and 18, 19 and 20.

During use, the hinged socket wrench speed handle may be utilized in two separate ways. First, when fastening a bolt or nut, an appropriate socket is attached and the hinge pin 40 is pushed to the side, with the removable head 52 contiguous with the clevis 28. The workpiece is started on its threads manually or inserted into the socket and rotated by spinning the offset handle in a circular direction. When the workpiece is snug, the tool is pushed downward to a convenient position in a single smooth motion. Tightening is then completed by rotation at the appropriate angle, using the handle as a lever arm. The second way of utilizing the hinged socket wrench speed handle is to lock the drive head 30 in place by manually pushing the pin 40 until the rivet head 78 or hinge pin stop 82 is adjacent to the clevis 28, and using the tool as a flex handle or a bull handle.

The second embodiment of the invention is illustrated in FIGS. 12–14, 17–20 and 23, and is basically the same as the preferred embodiment except a second clevis 28 is added to the second end 24 of an offset shank 20*a*. The offset shank 20*a* is shown by itself in FIG. 17, and the clevis 28 is identical, however the bends 26 are a full 90-degrees and the overall length is illustrated shorter than the drawings of the preferred embodiment. The difference in configuration as it will be noted that the angles may be from 10 to 90-degrees and the length is of little importance, as it depends upon the size of the drive and the wrenches ultimate utility.

A second head is mounted in the second clevis 28 and differs in that it attaches directly to the handle 58, therefore it is designated a body head 44 instead of the drive head 30. The body head 44 has the same radial shape and flat sides, including the depressions 36, as the drive head, except instead of the square drive end, a cylindrical portion extends outward and interfaces with the handle 58 in the same manner as the second end 24 of the preferred shank 20, as illustrated in FIG. 14. The cylindrical portion of the head 44 includes an internal groove 62 and interfaces with the same round retaining ring 60, thereby permitting the handle to rotate freely on the head extended portion.

Figure 18:
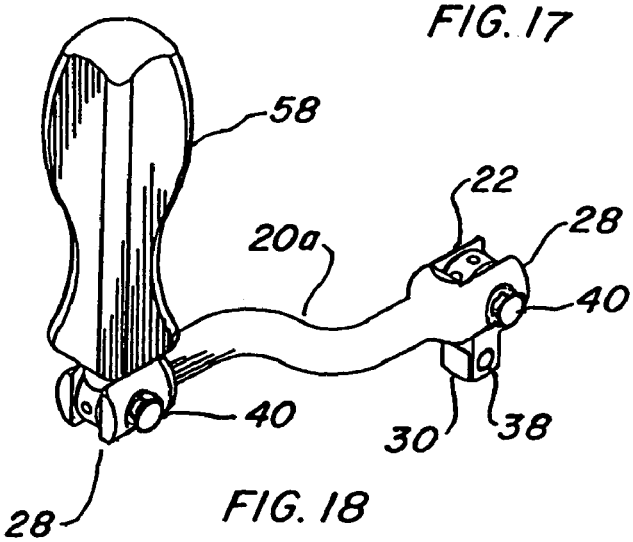
FIG. 18 is a partial isometric view of the second embodiment with the handle adjusted to a vertical position and having attached a square drive head.
Figure 19:
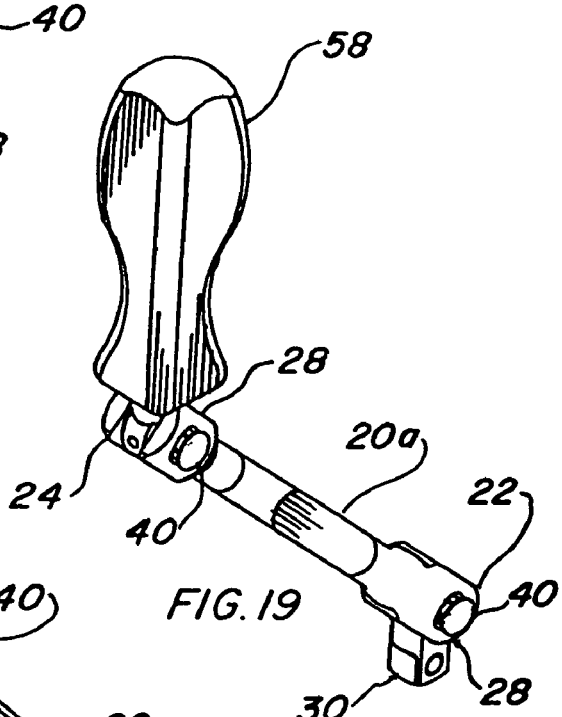
FIG. 19 is a partial isometric view of the second embodiment with the handle adjusted to a vertical position and the shank at a 45-degree angle.
Figure 20:
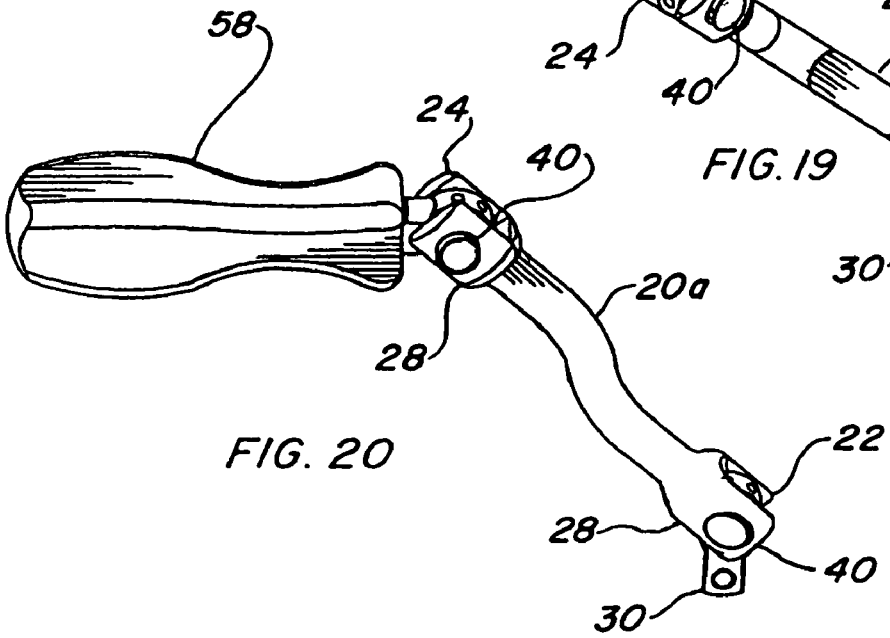
FIG. 20 is a partial isometric view of the second embodiment with the handle adjusted to a horizontal position and the shank at a 45-degree angle.

Since the body head 44 functions in the same manner as the square drive head 30, and the same hinge pin 40 is utilized along with the head detent 38 assuring the angular position of the head, the wrench may now have the handle 58 adjusted to the optimum position for leverage and convenience, as illustrated in FIGS. 18–20. It will be plainly seen that the utility of the wrench, by spinning the offset handle in a circular direction to snug a workpiece, is not altered in any way, only its usefulness is enhanced by relocating the angle of the handle to best suit the particular circumstance. For example, the drive head 30 can be attached to one end of a straight rod, wherein the rod's opposite end has a T-handle connected which functions as a speed handle for rotating the wrench.

While the invention has been described in detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

The invention claimed is:

1. An improved socket wrench speed handle for tool sockets of the type having, a) an offset shank having a first end and a second end, b) a clevis that is integrally formed into the first end, forming at least one bifurcated fork, c) at least one pivoting head disposed within the bifurcated fork, with one head configured to accept wrench sockets, said head configured to accept wrench sockets defining a drive head that further includes angular position retaining means to intersect rotation at equally spaced discrete positions comprising a spring-loaded detent ball that is disposed within said bifurcated fork, wherein said drive head is configured to accept wrench sockets having a plurality of depressions at coequal spaces such that the detent ball intersects with the depressions, thus retaining the drive head in a specific position, and also securing the drive head, d) a hinge pin disposed through at least one head and clevis bifurcated fork, thus permitting the drive head to pivotally rotate and lock within the confines of the clevis, wherein said hinge pin is slideable and held in position by lateral urging of said spring-loaded detent ball, and e) a rotatable handle attached to the second end of the shank for rotating the wrench upon reciprocation of the handle, and radial turning when urged at substantially right angles to the pivoted drive head, wherein the improvement comprises:

said hinge pin having a body with at least one round segment and at least one square segment, and means for retaining the hinge pin within the hinged socket wrench speed handle, wherein said round segment is larger in diameter than across the flats of said square segment, wherein said drive head having a combined round and octagonal hole therethrough, and said clevis having a combined round and square hole through at least one fork of the clevis, such that when the hinge pin is manually urged in a first direction the pin is retained in the drive head and rotates freely within the clevis, and when the hinge pin is urged in an opposite second direction the square segment intersects with the shank clevis, thereby locking the drive head in place.

2. The hinged socket wrench speed handle for tool sockets as recited in claim 1 wherein said hinge pin further comprising a bore therethrough and a rivet disposed within the bore, said rivet having a larger diameter head and bucked end than the combined round and square hole through each fork of the clevis, thereby forming a limiting restriction that retains the hinge pin in the fork clevis.

3. The hinged socket wrench speed handle for tool sockets as recited in claim 1 wherein said hinge pin further comprising a threaded extended neck on at least one end, and a hinge pin stop disposed upon at least one neck, with a screw fastened within the threads of at least one neck, said hinge pin stops having a larger diameter than the combined round and square hole through each fork of the clevis, thereby forming a limiting restriction that retains the hinge pin the fork clevis.

4. The hinged socket wrench speed handle for tool sockets as recited in claim 1 wherein said hinge pin further comprises a body having at least one round segment and at least one square segment, and said at least one pivoting head having a combined round and octagonal hole through said pivoting head with the round hole bored through the at least one pivoting head, and two square holes broached at an equal distance apart within the round hole leaving internal intervening points radially truncated such that the hinge pin may slide easily inside the pivoting head without interference while leaving the outside points sharp when interfacing with the square segments of the hinge pin.

5. An improved hinged socket wrench speed handle for tool sockets of the type having:

a) an offset shank having a first end and a second end, b) a clevis that is integrally formed into the shanks first end and second end, forming a bifurcated fork, c) a first head defining a drive head that is pivotally disposed within the shank's first end bifurcated fork to accept wrench sockets, d) a second head defining a handle head that is pivotally disposed within the shank's second end bifurcated fork to accept a handle, e) a hinge pin disposed through both the handle head and the second end of the clevis bifurcated fork, thus permitting each head to pivotally rotate and lock within the confines of its respective clevis, and f) a rotatable handle attached to the handle head for rotating the wrench upon reciprocation of the handle, and radial turning when urged at substantially right angles to pivoted drive head, wherein the improvement comprises:

said hinge pin having a body with at least one round segment and at least one square segment, and means for retaining the hinge pin within the hinged socket wrench speed handle, wherein said round segment is larger in diameter than across the flats of said square segment, wherein said drive head having a combined round and octagonal hole therethrough, and said clevis having a combined round and square hole through at least one fork of the clevis, such that when the hinge pin is manually urged in a first direction the pin is retained in the drive head and rotates freely within the clevis, and when the hinge pin is urged in an opposite second direction the square segment intersects with the shank clevis, thereby locking the drive head in place.

6. The hinged socket wrench speed handle for tool sockets as recited in claim 5 wherein said hinge pin further comprising a bore therethrough and a rivet disposed within the bore, wherein said rivet having a larger diameter head and bucked end than the combined round and square hole through each fork of the clevis, thereby forming a limiting restriction that retains the hinge pin in the fork clevis.

7. The hinged socket wrench speed handle for tool sockets as recited in claim 5 wherein said hinge pin further comprising a threaded extended neck on at least one end, and a hinge pin stop disposed upon at least one neck, with a screw fastened within the threads of at least one neck, wherein said hinge pin stops having a larger diameter than the combined round and square hole through each fork of the clevis, thereby forming a limiting restriction that retains the hinge pin the fork clevis.

8. The hinged socket wrench speed handle for tool sockets as recited in claim 5 wherein said hinge pin further comprises a body having at least one round segment and at least one square segment, and said at least one pivoting head having a combined round and octagonal hole through said pivoting head with the round hole bored through the at least one pivoting head, and two square holes broached at an equal distance apart within the round hole leaving internal intervening points radially truncated such that the hinge pin may slide easily inside the pivoting head without interference while leaving the outside points sharp when interfacing with the square segments of the hinge pin.

9. In a method producing a hinged socket wrench speed handle for tool sockets of the type having the steps of:

a) producing an offset shank, b) forming an integral clevis within the offset shank, with said clevis having at least one bifurcated fork, c) attaching at least one pivoting head within at least one bifurcated fork, d) inserting a hinge pin through at least one head and at least one clevis bifurcated fork, and e) attaching a rotable handle to the offset shank for rotating the wrench upon reciprocation of the handle, and radial turning when urged at substantially right angles to the pivoted drive head, the improvement comprising:

(1) forming a combined round and octagonal hole through said pivoting head by boring a round hole through the pivoting head, and (2) broaching two square holes at an equal distance apart within the round hole leaving internal intervening points radially truncated such that a hinge pin having a body with at least one round segment and at least one square segment may slide easily inside the pivoting head without interference while leaving the outside points sharp when interfacing with the square segments of the hinge pin.

* * * * *